US008256458B2

(12) United States Patent
Angst

(10) Patent No.: US 8,256,458 B2
(45) Date of Patent: Sep. 4, 2012

(54) DEVICE FOR THE PREVENTION OF HIGH OIL TANK PRESSURES UNDER NEGATIVE G CONDITIONS

(75) Inventor: Robert Angst, Berlin (DE)

(73) Assignee: Rolls-Royce Deutschland Ltd Co KG (DE)

( * ) Notice: Subject to any disclaimer, the term of this patent is extended or adjusted under 35 U.S.C. 154(b) by 447 days.

(21) Appl. No.: 12/556,224

(22) Filed: Sep. 9, 2009

(65) Prior Publication Data

US 2010/0126589 A1 May 27, 2010

(30) Foreign Application Priority Data

Nov. 25, 2008 (DE) ..... 10 2008 058 981

(51) Int. Cl.
*E03B 11/00* (2006.01)
*F17D 1/00* (2006.01)

(52) U.S. Cl. ..... 137/590; 244/135 R

(58) Field of Classification Search ..... 137/590, 137/197, 899.2, 587, 43; 184/6.11; 244/135 R
See application file for complete search history.

(56) References Cited

U.S. PATENT DOCUMENTS

| | | | | |
|---|---|---|---|---|
| 2,245,198 | A | 6/1941 | Hunter et al. | |
| 2,679,333 | A * | 5/1954 | Starck | 220/746 |
| 2,982,374 | A * | 5/1961 | Hughes et al. | 96/187 |
| 3,049,138 | A | 8/1962 | Klank | |
| 3,130,022 | A | 4/1964 | Clark | |
| 3,889,705 | A * | 6/1975 | Coderre | 137/171 |
| 4,287,913 | A * | 9/1981 | Bennett et al. | 137/574 |
| 5,141,179 | A | 8/1992 | Gautier | |
| 5,836,421 | A | 11/1998 | Leicht | |
| 6,463,819 | B1 | 10/2002 | Rago | |

FOREIGN PATENT DOCUMENTS

| | | |
|---|---|---|
| DE | 896598 | 11/1953 |
| DE | 69102468 | 12/1994 |
| DE | 19529733 | 12/1996 |
| DE | 60123821 | 2/2007 |
| EP | 1167859 | 1/2002 |
| GB | 2059372 | 4/1981 |
| JP | 58113811 | 8/1983 |

OTHER PUBLICATIONS

German Search Report dated Apr. 22, 2009 from counterpart German patent application.
European Search Report dated May 18, 2011 from counterpart application.

* cited by examiner

*Primary Examiner* — John Rivell
*Assistant Examiner* — Seth Faulb
(74) *Attorney, Agent, or Firm* — Timothy J. Klima; Shuttleworth & Ingersoll, PLC

(57) ABSTRACT

An aircraft gas-turbine oil tank has a breather outlet tube 2 branching off from an upper area of the oil tank 1 and connecting to a breather and a connecting tube 6 joining to a bottom area of the oil tank 1. An air guide tube which is open at both ends is arranged in the upper area of the oil tank 1, with the air guide tube 3 protruding into the breather outlet tube 2 and extending into a middle area of the oil tank 1.

8 Claims, 1 Drawing Sheet

P1 > P2

P1 >> P2

DEVICE FOR THE PREVENTION OF HIGH OIL TANK PRESSURES UNDER NEGATIVE G CONDITIONS

Figure 1:
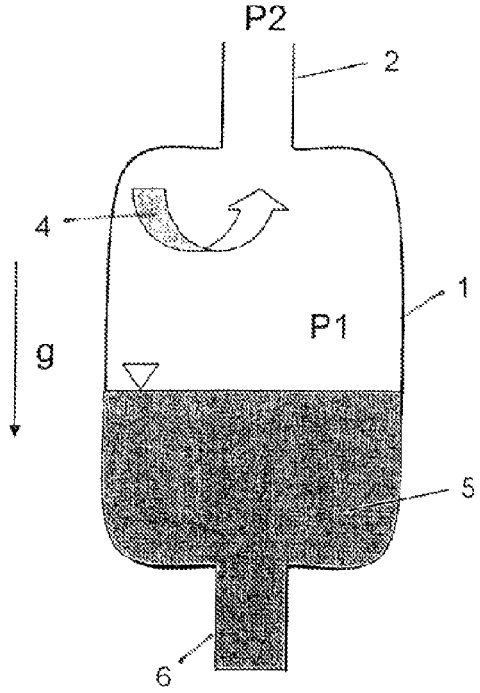
Fig. 1 (Prior Art)

This application claims priority to German Patent Application DE 10 2008 058 981.0 filed Nov. 25, 2008, the entirety of which is incorporated by reference herein.

This invention relates to a device for the prevention of high oil tank pressures under negative g conditions.

More particularly, the present invention relates to an oil tank with a breather outlet tube branching off from an upper area of the oil tank and connecting to a breather and with a breather connecting tube joining to a bottom area of the tank.

Under normal, positive g conditions, gravity acts such that the oil in an oil tank gathers in the bottom area of the tank. Air, which is possibly contaminated by oil particles, is present above the oil. This air is fed to a breather in which the oil particles are separated.

Under negative g conditions, gravity acts in the reverse or partly reverse direction. Consequently, the content of the oil tank will not gather in the bottom area of the oil tank, but in the upper area where the breather outlet tube is arranged. Under negative g conditions, the latter will be blocked by the oil.

This is disadvantageous in that the outlet tube of the breather is filled with oil and, furthermore, oil instead of air is delivered to the breather.

Consequently, a drastic increase of the pressure in the oil tank occurs, in particular since the scavenge pumps continue to feed oil into the tank. This can lead to problems regarding the pressure strength of the oil tank.

Moreover, the pressure loss in the breather is increased in that the latter is blocked or clogged with oil. This leads to oil leakages, contamination of bleed air, smell of oil in the aircraft cabin and sealing problems in the bearing chambers of an aircraft gas turbine.

In a broad aspect, the present invention provides an aircraft gas-turbine oil tank of the type specified above, while being simply designed and easily and cost-effectively manufactured, provides for a high degree of operational safety and, in particular, is operational especially under negative g conditions.

Therefore, according to the present invention, provision is made for an air guide tube arranged in the upper area of the oil tank. This air guide tube is open at both ends and extends into the breather outlet tube, protruding into the latter and issuing with its other end into the middle area of the oil tank.

The arrangement according to the present invention prevents high pressure from occurring in the oil tank under negative g conditions. The air guide tube provides for pressure compensation between the breather outlet tube (the vent line of the oil tank) and the interior of the oil tank. This pressure compensation is automatically effected by the air guide tube.

The air flowing through the air guide tube expands in the area of the breather outlet tube leading to the breather, thereby reducing the flow area available to the oil volume flow to the breather in the breather outlet tube.

Since air is fed through the air guide tube into the breather outlet tube and, thus, into the breather, pressure build-up in the oil tank is avoided.

Hence, the air guide tube according to the present invention is a tube extending from a vent opening (breather outlet tube or vent tube) of the oil tank into the interior of the oil tank. For this, the air guide tube is located such in the oil tank that venting of the oil tank, in particular under positive g conditions, is not blocked.

According to the present invention, the length of the air guide tube can be selected such that the latter, under normal g conditions, extends to beneath the oil filling level and, consequently, immerges into the oil.

If the pressure in the oil tank is now increased under negative g conditions, the air guide tube will provide for the following:

Also under negative g conditions, oil will flow into the breather outlet tube and, thus, into the breather in correspondence with the pressure gradient. This oil is sucked from the breather outlet tube, other than the remainder of the oil in the oil tank. With the air guide tube provided according to the present invention, air is now relatively quickly sucked from the inner area of the oil tank into the breather outlet tube.

Owing to the lower viscosity, the quantity of air drawn into the breather outlet tube is substantially larger than that of oil. As a result of the lower pressure, the air expands in the breather outlet tube, thereby decreasing the flow area available to the oil. Therefore, further oil flow through the breather outlet tube to the breather is reduced.

The air exiting through the air guide tube counteracts a strong pressure increase in the oil tank resulting from entering vent volumes and return volumes of oil.

Thus, according to the present invention, provision is made for preventing extreme pressures in the oil tank as well overflow of the breather. Under normal g conditions, the air guide tube will have no or only extremely small effect.

The air guide tube according to the present invention is stationarily arranged in the oil tank and has no moving components whatsoever. Provision is made for arrangement on a wall of the oil tank, with the air guide tube being arrangeable in the middle of the oil tank. Likewise, the diameter of the air guide tube is simply adaptable to the respective conditions. The design according to the present invention minimizes the risk of wear and/or malfunction. Another advantage is that the air guide tube in accordance with the present invention is very cost-effectively implementable and retroactively fittable to existing tank designs.

The present invention is more fully described in light of the accompanying drawings showing a preferred embodiment. In the drawings, FIG. 1 is a schematic representation of an oil tank under positive g conditions in accordance with the state of the art, FIG. 2 is a representation, analogically to FIG. 1, under negative g conditions in accordance with the state of the art, FIG. 3 is a representation, analogically to FIG. 1, of an embodiment in accordance with the present invention under positive g conditions, and FIG. 4 is a representation, analogically to FIG. 2 of an embodiment in accordance with the present invention under negative g conditions.

FIGS. 1 to 4 schematically show an oil tank 1 in the upper area of which a breather outlet tube 2 leading to a breather is arranged. In the bottom area of the oil tank 1, a connecting tube 6 is provided which joins to a return line, for example. The oil tank 1 contains oil 5, as shown in FIG. 1 for positive g conditions. Here, the oil 5 is in the bottom area of the oil tank 1, the air above the oil 5 has a pressure P1, and a pressure P2 exists in the breather outlet tube 2. The arrowhead 4 indicates the airflow.

Figure 2:
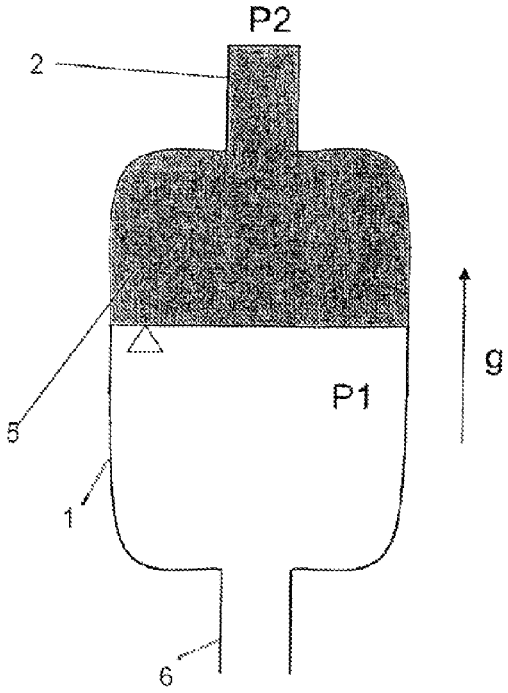
Fig. 2 (Prior Art)

In operating states with negative g conditions, the oil according to the state of the art is displaced into the upper area of the oil tank 1, as shown in FIG. 2. Here, a pressure P2 continues to apply in the breather outlet tube 2, while a pressure P1 existing beneath the oil 5 is further increased by pumping more oil through the connecting tube 6.

Figure 3:
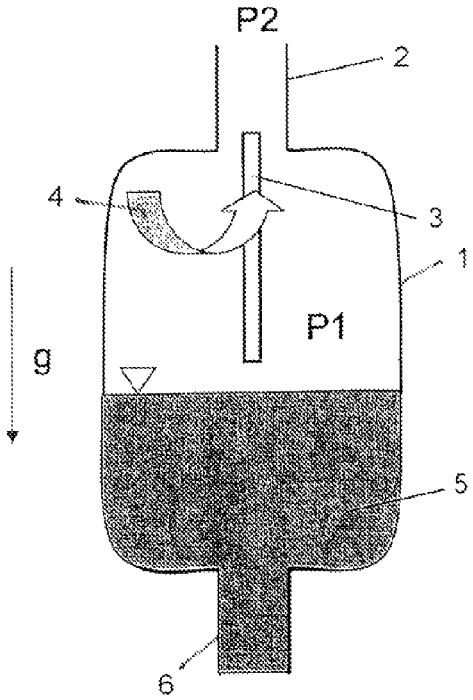
Figure 4:
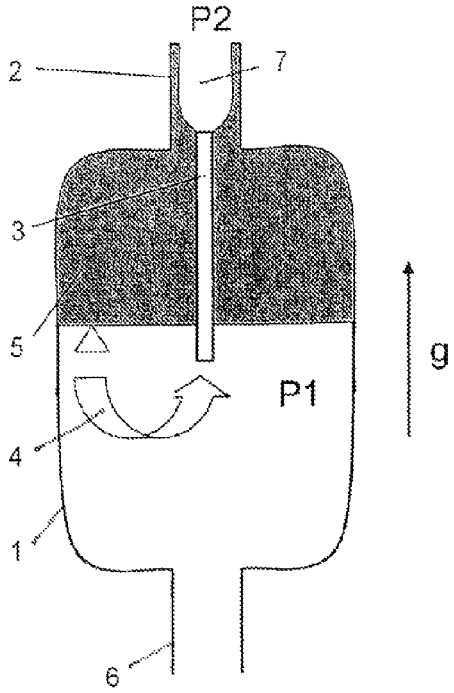

FIGS. 3 and 4 show an embodiment according to the present invention with a schematically illustrated air guide tube 3. FIG. 3 shows an operating state with positive g conditions. Here, the oil 5 is in the bottom area of the oil tank 1, the air guide tube 3 is "out of service". The pressures shown apply, with P1>P2.

Under negative g conditions (FIG. 4), the oil, analogically to the representation in FIG. 2, is forced into the upper area of the oil tank and introduced into the breather outlet tube. In the process, air flows according to the present invention from the bottom area of the oil tank 1 through the air guide tube 3 into the breather outlet tube 2. There, the air expands, as shown by reference numeral 7. Despite the significantly larger pressure P1>P2, adequate venting is provided, as indicated by the airflow 4 in FIG. 4.

List of Reference Numerals

1 Oil tank
2 Breather outlet tube
3 Air guide tube
4 Airflow
5 Oil
6 Connecting tube
7 Expanding air

What is claimed is:

1. An oil tank for an aircraft gas-turbine, comprising: a breather outlet tube branching off from an internal upper area of the oil tank to an exterior of the oil tank to be connectable to a breather;

a connecting tube joining to an internal lower area of the oil tank;

an air guide tube positioned in the internal upper area of the oil tank and having first and second open ends flowingly connected to one another through the air guide tube, the air guide tube protruding into the breather outlet tube such that the first open end is positioned within the breather outlet tube, the air guide tube also extending further internally into the oil tank such that the second open end is positioned within the oil tank to be open to air within the oil tank when oil in the oil tank is forced to the internal upper area of the oil tank under negative g conditions.

2. The oil tank of claim 1, wherein, under normal operating states of the oil tank with positive g conditions, the air guide tube essentially extends in a vertical direction.

3. The oil tank of claim 2, wherein, under normal operating states of the oil tank with positive g conditions, the second open end of the air guide tube is positioned above an oil filling level.

4. The oil tank of claim 1, wherein, under normal operating states of the oil tank with positive g conditions, the second open end of the air guide tube is positioned above an oil filling level.

5. A method for venting an oil tank, comprising:

providing an oil tank having an upper area and a lower area;

providing a breather outlet tube connected to an upper area of the oil tank and extending to an exterior of the oil tank to be connectable to a breather;

providing a connecting tube joining to the internal lower area of the oil tank;

providing an air guide tube having first and second open ends flowingly connected to one another through the air guide tube;

positioning the air guide tube in the upper area of the oil tank such that the air guide tube protrudes into the breather outlet tube with the first open end positioned within the breather outlet tube; and extending the air guide tube further internally into the oil tank such that the second open end is positioned within the oil tank to be open to air within the oil tank such that under negative g conditions where oil is forced to the internal upper area of the oil tank, the air guide tube allows air to be sucked from the second open end into the breather outlet tube through the first open end.

6. The method of claim 5, wherein, under negative g conditions, because of a lower viscosity of air as compared to oil, a quantity of air drawn into the breather outlet tube is substantially larger than that of oil.

7. The method of claim 5, wherein, under negative g conditions, because of a lower pressure in the breather outlet tube as compared to the oil tank, the air expands in the breather outlet tube upon exiting the first open end of the air guide tube, thereby decreasing a flow area available to the oil and thus, a flow of oil through the breather outlet tube.

8. The method of claim 5, wherein, under negative g conditions, the air exiting through the air guide tube counteracts a strong pressure increase in the oil tank resulting from entering vent volumes and return volumes of oil.

* * * * *